United States Patent [19]

Prevignano et al.

[11] Patent Number: 4,602,881

[45] Date of Patent: Jul. 29, 1986

[54] WIRE PRINTING DEVICE WITH INTERNAL SUPPORTS FOR THERMAL CONDUCTION

[75] Inventors: Paolo Prevignano; Armando Peretti, both of Ivrea; Francesco Bernardis, Chiaverano; Contardo Adamoli, Castellamonte, all of Italy

[73] Assignee: Ing. C. Olivetti & C., S.p.A., Ivrea, Italy

[21] Appl. No.: 743,872

[22] Filed: Jun. 12, 1985

Related U.S. Application Data

[63] Continuation of Ser. No. 541,316, Oct. 12, 1983, abandoned.

[30] Foreign Application Priority Data

Oct. 12, 1982 [IT] Italy ..... 68193 A/82

[51] Int. Cl.[4] ..... B41J 3/10

[52] U.S. Cl. ..... 400/124; 400/719; 101/93.05

[58] Field of Search ..... 400/124, 679, 719; 101/93.05

[56] References Cited

U.S. PATENT DOCUMENTS

| | | | |
|---|---|---|---|
| 3,861,503 | 1/1975 | Nash | 188/276 |
| 3,904,011 | 9/1975 | Matschke et al. | 400/124 |
| 3,929,214 | 12/1975 | Herbert | 400/124 |
| 4,009,772 | 3/1977 | Glaser et al. | 400/124 |
| 4,044,878 | 8/1977 | Kunath | 400/124 |
| 4,165,940 | 8/1979 | Cacciola | 400/124 |
| 4,236,837 | 12/1980 | Seilly | 400/124 |
| 4,279,521 | 7/1981 | Kightlinger | 400/124 |
| 4,335,969 | 6/1982 | Ott | 400/124 |
| 4,350,450 | 4/1982 | Dürr et al. | 400/124 |

FOREIGN PATENT DOCUMENTS

| | | | |
|---|---|---|---|
| 56-58883 | 5/1981 | Japan | 400/124 |
| 57-20368 | 2/1982 | Japan | 400/124 |
| 2030520 | 4/1980 | United Kingdom | 400/124 |

*Primary Examiner*—Edgar S. Burr
*Assistant Examiner*—David A. Wiecking
*Attorney, Agent, or Firm*—Banner, Birch, McKie & Beckett

[57] ABSTRACT

A ballistic type wire printing head comprises a metal front support (11) for guiding the printing wires (23) and supporting a group of actuating electromagnetic units (37, 39, 41) associated with the wires. The armatures (41) of the electromagnetic units are pre-assembled on a disc (40) of plastics material. A rear cover (59) which is also of metal encloses the electromagnetic units and in its interior supports spring spider (58) which co-operates with all the armatures of the electromagnetic units. The electromagnetic units have a common internal, ferromagnetic support (35) from which heat is conducted to the front support (11) and cooling fins (25). In a second embodiment, the printing head also comprises a second group of electromagnetic units associated with another series of printing wires. In that case, an intermediate metal member acts as a cover member for the first group of electromagnetic units and as a support for the second group of electromagnetic units.

10 Claims, 9 Drawing Figures

WIRE PRINTING DEVICE WITH INTERNAL SUPPORTS FOR THERMAL CONDUCTION

This is a continuation of application Ser. No. 541,316, filed Oct. 12, 1983, now abandoned.

The present invention relates to a ballistic type wire printing head comprising a plurality of wires which are displaceable axially in a front support and which are impelled by the armatures of a corresponding plurality of actuating electromagnetic units.

A printing head of this type is known, in which the enlarged pole portions of each electromagnetic unit are mounted individually on a metal support plate which is disposed transversely with respect to the wires. Mounted at the centre of the metal plate is a longitudinal support of plastics material, the function of which is to guide the wires along predetermined paths in the section between the armatures of the electromagnetic units and the front part of the head. The head also comprises a second group of electromagnetic units, the armatures of which are associated with another series of wires which are guided by the same longitudinal support and the enlarged pole portions of which are mounted individually on a second metal support plate which is disposed parallel to the first and secured thereto by means of screws.

While such a head has the advantage of being modular in nature, insofar as the second metal support plate, the associated group of electromagnetic units and the second series of wires can be removed without modifying the adjustment of the first group of wires and electromagnetic units, that head suffers from the disadvantage of having a very high number of parts which must be mounted individually of each other. In addition, the head is also heavy, cumbersome and bulky and is not suited for use in small-size, low-cost printers or typewriters.

The object of the present invention is to provide a printing head which is modular, light, small in size and very compact and which at the same time is capable of providing very good dissipation of the heat produced by energisation of the rolls of the actuating electromagnetic units.

In accordance with this object, the printing head according to the invention is characterised in that the front support is metal and comprises a transverse flange and a longitudinal cavity in which transverse guide plates for the wires are mounted, in that the group of electromagnetic units comprises a single internal support of ferromagnetic material having a transverse disc which contacts the transverse flange for transmitting to the front support the heat which is developed during energisation of the electromagnetic units, and in that a metal cover member is mounted over the group of electromagnetic units in contact with the transverse flange of the front support.

Figure 1:
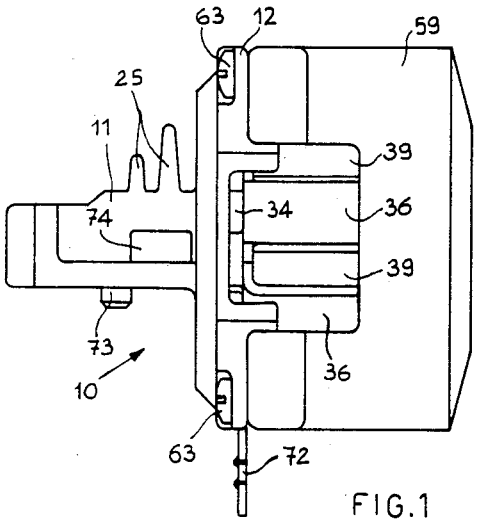
Figure 2:
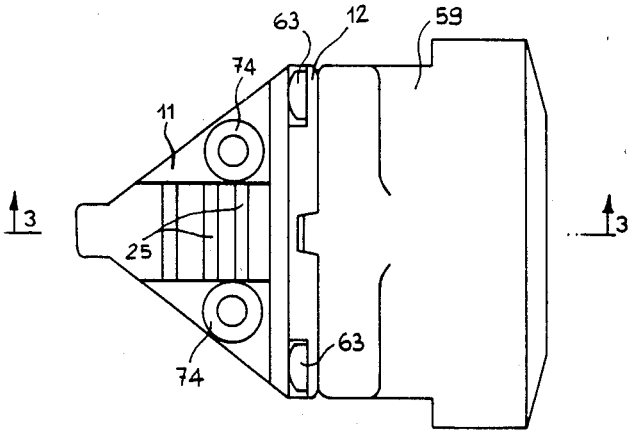
Figure 3:
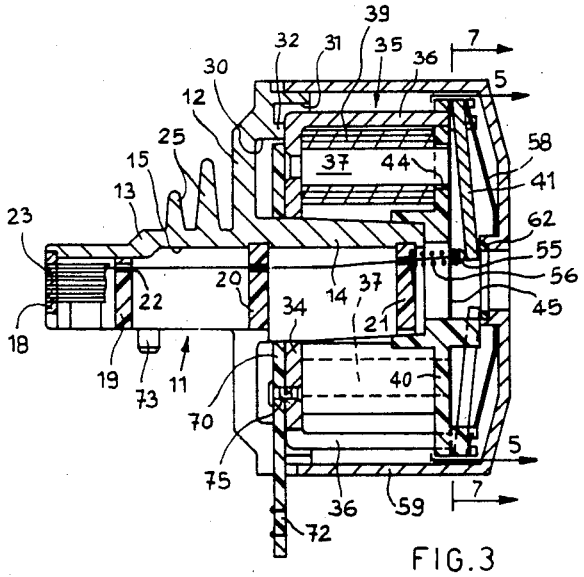
Figure 4:
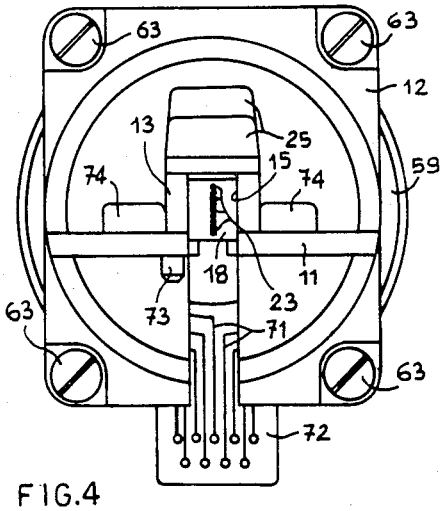
Figure 5:
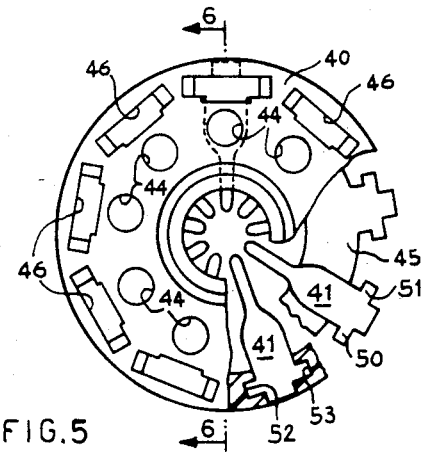
Figure 6:
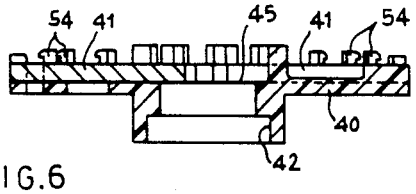
Figure 7:
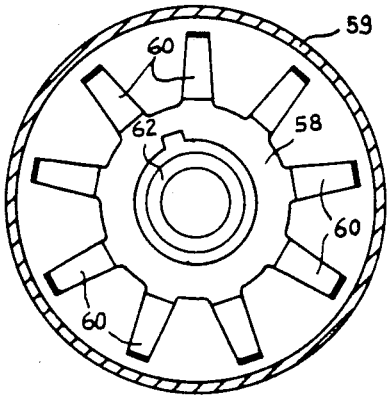
Figure 8:
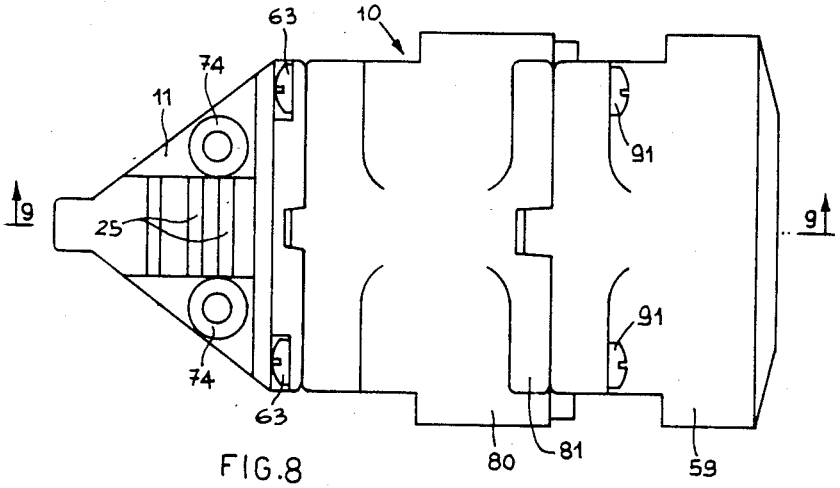
Figure 9:
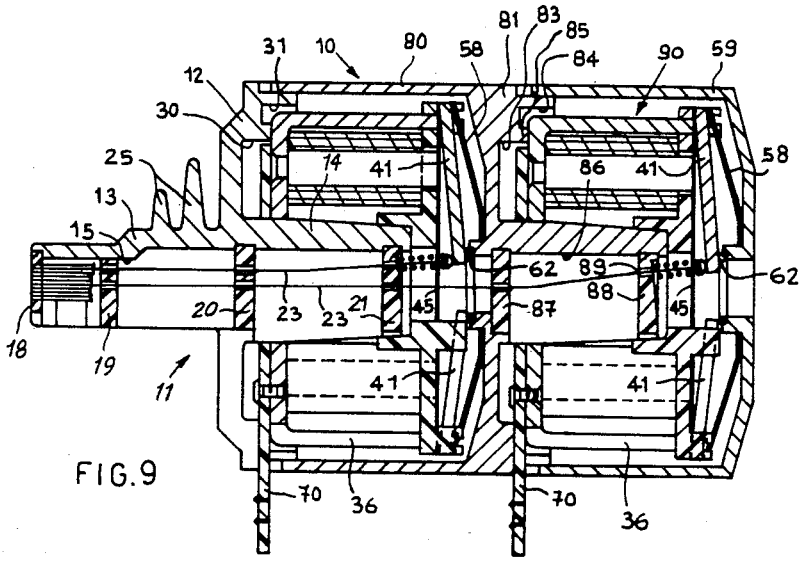

The invention will be described in more detail, by way of example, with reference to the accompanying drawings, in which:

FIG. 1 is a side view of a first embodiment of a printing head according to the invention, FIG. 2 is a plan view of the printing head shown in FIG. 1, FIG. 3 is a view in section taken along line 3—3 in FIG. 2, FIG. 4 is a front view of the printing head shown in FIG. 1, FIG. 5 is a view in section taken along line 5—5 in FIG. 3, FIG. 6 is a view in section taken along line 6—6 in FIG. 5 on an enlarged scale, FIG. 7 is a view in section taken along line 7—7 in FIG. 3, FIG. 8 is a plan view of a second embodiment of a printing head according to the invention, and FIG. 9 is a view in section taken along line 9—9 in FIG. 8.

Referring to FIG. 1, in a first embodiment, a printing head 10 according to the invention comprises a front support 11 made of a metal which can be easily shaped by means of pressure die-casting, for example zamak alloy, which is shaped in such a way as to provide a central flange 12 (see FIG. 3), a front portion 13 which is substantially of an inverted U-shape (see FIG. 4) and a rear portion 14 (see FIG. 3) which is of substantially cylindrical shape. Zamak is a zinc, aluminium alloy containing about 4% aluminium, 0.04% magnesium and up to 3% copper.

The support 11 has a longitudinal cavity 15 and four transverse plates 18, 19, 20 and 21 of plastics material are fitted into and stuck in the cavity 15, being parallel to each other. Each of the four transverse plates 18, 19, 20 and 21 is provided with holes 22 therethrough to act as a guide for a plurality of metal printing wires 23. In this first embodiment, there are nine printing wires 23 and they have their front printing ends aligned in a single column (see FIG. 4).

Provided on the front portion 13 of the support 12 are two upper vertical fin portions 25 for enhanced dissipation of the heat developed in operation of the printing head 10.

The central flange 12 of the support 11 is so shaped as to define two cylindrical cavities 30 and 31 and a circular shoulder 32 (see FIG. 3).

Disposed in the cylindrical cavity 31 and in contact with the circular shoulder 32 is a transverse disc 34 of an internal support 35 of ferromagnetic material, which has a series of longitudinal fin portions 36 which are angularly equally spaced from each other. The number of fin portions 36 is equal to the number of printing wires 23.

Cylindrical cores 37, which are also of ferromagnetic material, are riveted to the transverse disc 34, in association with the fin portions 36 respectively and parallel thereto. Each core 37 is encircled by a corresponding energisation coil 39.

Mounted on a transverse disc 40 of plastics material (see FIGS. 3, 5 and 6) are armatures 41 which are disposed in a radiating configuration and which each cooperate with a corresponding fin portion 36, a core 37 and the inner ends of a wire 23. Interposed between the armatures 41 and the disc 40 is a sheet 45 of plastics material, which is some hundredths of a millimeter in thickness.

In this way, the cores 37, the coils 39, the fin portions 36 and the armatures 40 form a series of electromagnetic actuating units associated with the printing wires 23.

The transverse disc 40 has a central hole 42, within which is housed the more inward end of the rear portion 14 of the support 11, and a series of nine through holes 44, within each of which is housed the end of a core 37. Also provided in the disc 40, at the periphery thereof, are nine through apertures 46 in which the ends of the fin portions 36 are fixed.

Each armature 41 comprises two side lugs 50 and 51 which are housed in corresponding seats 52 and 53 in the transverse disc 40. Two resilient teeth 54 prevent each armature 41 from coming out of the seats 52 and 53 in normal operation of the arrangement, while permitting the armature 41 to be removed and replaced if required.

Each printing wire 23 has its inward end rigidly connected to a cap 55 of plastics material, with which a coil spring 56 co-operates. The spring 56, in the rest position, holds the corresponding wire 23 in a retracted and inoperative position.

A laminar spring spider 58 (see FIGS. 3 and 7) is mounted within a cover 59 and has nine radial arms 60 which each co-operate with a corresponding armature 41 to hold the peripheral end thereof as closely as possible to the corresponding fin portion 36. Also disposed within the cover member 59 is a rubber ring 62 against which, in the rest condition, all the inward ends of the armatures 41 bear by virtue of the force of the coil springs 56 and the spring 58. The cover 59, which is also made of zamak alloy, is fixed to the front support 11 by means of four screws 63 (see FIGS. 1, 2 and 4).

Housed in the cylindrical cavity 30 in the flange 12 is a disc 70 of insulating material, which carries the tracks or paths 71 for the supply of electrical power for the coils 39. A lower projecting portion 72 of the disc 70 has terminals for connection to energising connectors (not shown). The disc 70 is fixed to the disc 34 of the inner support 35 by means of screws 75 (only one thereof being visible in FIG. 3).

The front portion 13 of the support 11 is provided with a bottom centering pin 73 and with two seats 74 for the screws, by means of which the printing head 10 as described hereinbefore can be mounted on a carriage of a serial printer of known type.

The above-described printing head is assembled in the following manner:

The wires 23 complete with the caps 55 and the coil springs 56 are first fitted into the corresponding holes 22 in the transverse plates 18, 19, 20 and 21 which are successively inserted from below into the longitudinal cavity 15 in the support 11, and secured thereto by adhesive.

The array of electromagnetic actuating units is then fitted separately.

In particular, the coils 39 are wound on to the cylindrical cores 37. The disc 70 is fixed to the transverse disc 34 of the support 35 by means of the screws 75 and the terminals of the coils 39 are soldered to the electrical power supply tracks 71.

First the plastics sheet 45 and then the armatures 41 are mounted on the transverse disc 40. The disc 40 is then mounted to the ferromagnetic support 35 in such a way that the cores 37 are inserted into the holes 44 and the fin portions 36 are firmly fitted into the openings 46.

The group of electromagnetic units, which is formed in that way, is then mounted on the rear portion 14 of the support 11, in such a way that the disc 70 is housed in the cylindrical cavity 30 and the disc 35 bears against the circular shoulder 32 on the flange 12.

The cover member 59 on which the inner ring 62 and the spring 58 have been previously disposed is then fixed to the support 11 by means of the screws 63.

The above-described printing head 10 is very compact, light and small in size, the weight thereof being about 120 grams while its length is 45 mm and its maximum transversse dimension is 40 mm, as well as being particularly suitable for use in office typewriters.

The printing head 10 operates in known manner, by means of movement thereof parallel to a platen roller, and selective actuation of the electromagnetic units associated with the wires 23. More precisely, whenever one of the coils 39 has a current flowing therethrough, a magnetic flux is generated in the core 37, which causes the corresponding armature 41 to be attracted towards that core 37, and thus produces axial movement of the wire 23 associated therewith, which ballistically continues its forward travel, even after the armature 41 has been stopped against the sheet 45 which is interposed between the armatures and the cores 37. After a dot has been printed, the rebound force of the platen and the coil spring 56 cause the wire 23 to return towards the rest position, the coil 39 having been de-energised at the moment at which the armature 41 has terminated its forward travel.

The above-described printing head 10 is also modular, and FIGS. 8 and 9 show a second embodiment which includes a second group of electromagnetic units and print wires 23. In this second embodiment, a support 80 which is also made of zamak alloy is fitted in place of the cover 59.

The support 80 is of the same configuration at its front as the cover member 59 and in fact internally supports the spring 58 and the internal ring 62, and can be secured to the support 11 by means of the screws 63.

The front portion 81 of the support 80 on the other hand is substantially identical to the flange 12 and the portion 14 of the support 11.

In particular, the support 80 is of such a configuration as to define two cylindrical cavities 83 and a circular shoulder 85. The support 80 also has a longitudinal cavity 86 in which two further transverse plates 87 and 88 of plastics material are inserted and secured by adhesive, being parallel to each other. Each of the plates 87 and 88 is provided with holes 89 therethrough, to guide a second series of metal printing wires 23. In this embodiment, the second series of wires comprises nine further wires.

Disposed in the cylindrical cavity 84, and bearing against the circular shoulder 85, is a second group 90 of electromagnetic units identical to that described hereinbefore, which can cooperate with the second series of printing wires 23.

The cover 59 which is provided with another spring 58 and another internal rubber ring 62 is fitted so as to cover the second group of electromagnetic units, and secured to the support 80 by means of four screws 91.

It is obvious that in this second embodiment the transverse plates 18, 19, 20 and 21 are provided with holes 22 also for guiding the second series of wires 23. In particular, the wires are guided in such a way that their printing ends are aligned in two parallel columns.

It will also be apparent that the number of printing wires 23, if necessary, can be reduced in comparison with the number of wires specified hereinbefore by way of example.

Assembly and mode of operation of this second embodiment are similar to the first embodiment, and will therefore not be repeated, for the sake of brevity.

This second embodiment of the head 10 is also very compact, light and small in size, weighing about 200 grams and being about 72 mm in length, while its maximum transverse dimensions are equal to those of the first embodiment.

In both the above-described printing heads, the heat developed by energisation of the coils 39 is dissipated to the exterior by virtue of their structure and in particular to the fact that the internal support 35 of the group of electromagnetic units is in contact with the transverse flange 12 of the front metal support 11.

We claim:

1. In a wire device comprising a plurality of printing wires, means for axially guiding said printing wires, and actuating means connected with said printing wires and comprising a ferromagnetic support including a transversal disc and a plurality of longitudinal fin portions radially disposed about said rear longitudinal portion, a plurality of ferromagnetic cores fixed to said transversal disc and associated with said longitudinal fin portions, a plurality of energizable coils wound on said ferromagnetic cores, and a plurality of ferromagnetic armatures associated with said plurality of longitudinal fin portions and with said plurality of ferromagnetic cores, and connected with said plurality of wires, the improvement comprising:

a single metallic support means for supporting said guiding means, comprising a front longitudinal portion, a rear longitudinal portion, a central transversal portion, means defining an inner cavity for lodging said printing wires and said guiding means, means defining an outer cavity for accommodating said transversal disc, and a rear shoulder of circular shape in the outer cavity of said support;

a support disc having a first plurality of opening means for firmly fixing said longitudinal fin portions, and a second plurality of opening means for accommodating said ferromagnetic cores;

a metallic cover to contact the transversal portion of said metallic support assembly and said support disc; and a plurality of fixing means for solely fixing said transversal disc with said metallic cover externally to said transversal portion to hold the transversal disc in contact with the rear circular shoulder of said single metallic support element.

2. A wire printing device according to claim 1, further comprising a printed circuit fixed to the transversal disc of said ferromagnetic support, and having a plurality of conductors connected with said energizable coils, said printed circuit lodged in said outer cavity of the transversal portion of said single support element.

3. A wire printing device according to claim 1, wherein the front longitudinal portion of said single metallic support element comprises a plurality of heat dissipating fin portions.

4. A wire printing device according to claim 1, wherein a metallic cover is mounted to contact the transversal portion of said single metallic support element, and wherein a laminar spring carried by said metallic cover is able to cooperate with said plurality of ferromagnetic armatures for keeping said armatures away from the corresponding cores when said coils are de-energized.

5. A wire printing device comprising:

a single metallic support element including a first longitudinal portion, a rear longitudinal portion, a central traversal portion, means defining a longitudinal cavity in said two longitudinal portions, and means defining a cylindrical cavity and a rear circular shoulder in said transversal portion;

a plurality of printing wires disposed in said longitudinal cavity;

guide means carried by said two longitudinal portions and disposed into said longitudinal cavity for axially guiding said printing wires;

an actuating means for actuating said printing wires, said actuating means comprising:

a ferromagnetic support including a transverse disc mounted on said rear longitudinal portion, and a plurality of longitudinal fin portions radially disposed about said rear longitudinal portion, a plurality of ferromagnetic cores fixed to said transverse disc and associated with said longitudinal fin portions, a plurality of energizable coils wound on said ferromagnetic cores, a printed circuit fixed to said transverse disc of said ferromagnetic support, connected to said energizable coils, and lodged in said cylindrical cavity of said single metallic support element, a plurality of ferromagnetic armatures associated with said plurality of longitudinal fin portions and with said plurality of ferromagnetic cores, a support disc of non-magnetic material having a first plurality of opening means for firmly fixing said longitudinal fin portions, and a second plurality of opening means for accomodating said ferromagnetic cores and wherein said support disc engages with the rear longitudinal portion of said support element, a laminar spring means cooperating with said plurality of ferromagnetic armatures for keeping said armatures away from the corresponding cores when said coils are de-energized;

a metallic cover member including a rear transversal wall cooperative with said support disc and supporting said laminar spring and a peripheral wall contacting said transversal portion of said single metallic support element; and a plurality of fixing means for solely fixing said transverse disc with said metallic cover externally to said support disc to hold the transverse disc in contact with the rear circular shoulder of said single metallic support element.

6. A wire printing device comprising a first and a second plurality of printing wires; first actuating means connected to said first plurality of printing wires; a front metallic support assembly including first guide means for axially guiding said first and second plurality of printing wires, and first support means for supporting said first actuating means; second actuating means connected to said second plurality of printing wires; a rear metallic support assembly mounted to contact said front metallic support assembly and including second guide means for axially guiding said second plurality of printing wires, and second support means for supporting said second actuating means; and a metallic cover mounted to contact said rear metallic support assembly, wherein said front metallic support assembly comprises a front longitudinal portion, a first rear longitudinal portion, a first transversal portion, first means defining a first longitudinal cavity for lodging said first and second plurality of printing wires, and second means defining a first cylindrical cavity and a first rear circular shoulder in said first transversal portion.

7. A wire printing device according to claim 6, wherein said first actuating means comprises a first ferromagnetic transversal disc which supports a first plurality of electromagnets associated to said first plurality of printing wires, and a first printed circuit fixed to said first ferromagnetic transversal disc and connected to said first plurality of electromagnets, wherein said first ferromagnetic transversal disc is mounted on said first rear longitudinal portion to contact said first rear circular shoulder, and wherein said first printed circuit is lodged in said first cylindrical cavity of said front metallic support assembly.

8. A wire printing device according to claim 6, wherein said rear metallic support assembly comprises a second rear longitudinal portion and a second transversal portion, third means defining a second longitudinal cavity substantially aligned with said first longitudinal cavity for lodging said second plurality of printing wires, and fourth means defining a second cylindrical cavity and a second rear circular shoulder in said second transversal portion.

9. A wire printing device according to claim 8, wherein said second actuating means comprises a second ferromagnetic transversal disc which supports a second plurality of electromagnets associated to said second plurality of printing wires, and a second printed circuit fixed to said second ferromagnetic transversal disc and connected to said second plurality of electromagnets, wherein said second ferromagnetic transversal disc is mounted on said second rear circular shoulder, and wherein said second printed circuit is lodged in said second cylindrical cavity of said rear metallic support assembly.

10. A wire printing device comprising:

a first and a second plurality of printing wires;

first guide means for axially guiding said two pluralities of printing wires;

second guide means for axially guiding said second plurality of printing wires;

first actuating means connected to said first plurality of printing wires;

second actuating means connected to said second plurality of printing wires;

a first metallic support assembly for supporting said first guide means and said first actuating means;

a second metallic support assembly for supporting said second guide means and said second actuating means; and a metallic cover mounted to contact said second metallic support assembly;

wherein said first metallic support assembly comprises:

a first frontal longitudinal portion;

a first rear longitudinal portion;

a first transversal portion;

first means defining a first longitudinal cavity for lodging said first guide means; and second means defining a first cylindrical cavity and a first rear circular shoulder in said first transversal portion;

wherein said second metallic support assembly comprises:

a second frontal longitudinal portion;

a second rear longitudinal portion;

a second transversal portion;

third means defining a second longitudinal cavity substantially aligned with said first longitudinal cavity for lodging said second guide means; and fourth means defining a second cylindrical cavity and a second rear circular shoulder in said second transversal portion;

wherein said first actuating means comprises:

a first ferromagnetic support including a first transversal disc mounted on said first rear longitudinal portion and contacting said first rear circular shoulder of said first metallic support assembly, and a plurality of longitudinal fin portions radially disposed about said first rear longitudinal portion;

a first plurality of ferromagnetic cores fixed to said first transversal disc and associated with said first longitudinal fin portions;

a first plurality of energizable coils wound on said first plurality of ferromagnetic cores;

a first printed circuit fixed to said first transversal disc of said first ferromagnetic support, connected to said first plurality of energizable coils, and lodged in said first cylindrical cavity of said first transversal portion; and a first plurality of ferromagnetic armatures associated with said first plurality of longitudinal fin portions and with said first plurality of ferromagnetic cores, and connected to said first plurality of printing wires; and wherein said second actuating means comprises:

a second ferromagnetic support including a second transversal disc mounted on said second rear longitudinal portion and contacting said second rear circular shoulder of said second metallic support assembly, and a second plurality of longitudinal fin portions radially disposed about said second rear longitudinal portion;

a second plurality of ferromagnetic cores fixed to said second transversal disc and associated with said second longitudinal fin portions;

a second plurality of energizable coils wound on said second plurality of ferromagnetic cores;

a second printed circuit fixed to said second transversal disc of said second ferromagnetic support, connected to said second plurality of energizable coils, and lodged in said second cylindrical cavity of said second transversal portion; and a plurality of ferromagnetic armatures associated with said second plurality of longitudinal fin portions and with said second plurality of ferromagnetic cores, and connected to said second plurality of printing wires.

* * * * *